US007451898B2

(12) United States Patent
Seidita

(10) Patent No.: US 7,451,898 B2
(45) Date of Patent: Nov. 18, 2008

(54) TAMPER EVIDENT CLOSURE WITH LOCKING BAND

(75) Inventor: Thomas M. Seidita, Mechanicsville, VA (US)

(73) Assignee: Obrist Closures Switzerland GmbH, Reinach (CH)

( * ) Notice: Subject to any disclaimer, the term of this patent is extended or adjusted under 35 U.S.C. 154(b) by 0 days.

(21) Appl. No.: 10/775,885

(22) Filed: Feb. 9, 2004

(65) Prior Publication Data

US 2004/0155006 A1 Aug. 12, 2004

Related U.S. Application Data

(62) Division of application No. 10/241,416, filed on Sep. 11, 2002, now abandoned.

(51) Int. Cl.
*B65D 41/34* (2006.01)

(52) U.S. Cl. ..... 222/253; 222/258

(58) Field of Classification Search ..... 215/252, 215/258, 253–256

See application file for complete search history.

(56) References Cited

U.S. PATENT DOCUMENTS

| | | | | |
|---|---|---|---|---|
| 3,199,702 | A | 8/1965 | Fischbach | |
| 4,326,639 | A | 4/1982 | Stahl et al. | |
| 4,402,415 | A | 9/1983 | Hopely | |
| 4,550,844 | A | 11/1985 | Lininger | |
| 4,598,835 | A | 7/1986 | Brownbill | |
| 4,638,917 | A | 1/1987 | Persch | |
| 4,657,153 | A | 4/1987 | Hayes | |
| 4,739,893 | A | 4/1988 | Zumbuhl | |
| 4,801,031 | A * | 1/1989 | Barriac | 215/252 |
| 4,813,561 | A * | 3/1989 | Ochs | 215/252 |
| 4,971,212 | A * | 11/1990 | Kusz | 215/252 |
| 4,971,213 | A | 11/1990 | Ishinabe et al. | |
| 5,040,692 | A | 8/1991 | Julian | |
| 5,050,753 | A | 9/1991 | Trump et al. | |
| 5,056,675 | A | 10/1991 | Julian | |
| 5,090,581 | A | 2/1992 | Rose et al. | |
| 5,090,788 | A | 2/1992 | Ingram et al. | |

(Continued)

FOREIGN PATENT DOCUMENTS

| | | |
|---|---|---|
| DE | 8811108.3 | 9/1988 |

(Continued)

*Primary Examiner*—Lien T Ngo
(74) *Attorney, Agent, or Firm*—Knoble, Yoshida & Dunleavy, LLC

(57) ABSTRACT

A container assembly includes a container that has an externally threaded finish portion as well as retention structure for preventing upward movement of a tamper evident band. The container assembly further includes a closure having a body portion of a base and an internally threaded downwardly depending sidewall portion that is sized and shaped to screw onto the finish portion of the container. The closure further includes a tamper evident band that is frangibly connected to the sidewall portion and that includes a main band portion and a J-hook retention member. The J-hook retention member includes a plurality of pleated retaining elements, each of which has upper portion for engaging the retention structure. Advantageously, at least one of the pleated retaining elements is further constructed and arranged to engage the container so as to resist rotation with respect to the container, whereby separation of said tamper evident band from said body portion is better assured when the closure is unscrewed from the container.

17 Claims, 3 Drawing Sheets

U.S. PATENT DOCUMENTS

| | | | | | |
|---|---|---|---|---|---|
| 5,197,621 | A | | 3/1993 | Bartl et al. | |
| 5,263,600 | A | | 11/1993 | Henning | |
| 5,314,085 | A | | 5/1994 | Collado Bonet | |
| 5,356,019 | A | | 10/1994 | Kelly | |
| 5,400,913 | A | | 3/1995 | Kelly | |
| 5,415,306 | A | | 5/1995 | Luch et al. | |
| 5,533,633 | A | | 7/1996 | King | |
| 5,715,959 | A | | 2/1998 | Pfefferkorn et al. | |
| 5,749,201 | A | | 5/1998 | Cochrane | |
| 5,749,484 | A | | 5/1998 | Trout | |
| 5,782,369 | A | | 7/1998 | Tansey | |
| 5,860,542 | A | | 1/1999 | Takamatsu | |
| 5,913,437 | A | | 6/1999 | Ma | |
| 5,915,579 | A | | 6/1999 | Przytulla et al. | |
| 5,964,139 | A | | 10/1999 | Spatz et al. | |
| 6,085,921 | A | * | 7/2000 | Brown | 215/252 |
| 6,109,464 | A | * | 8/2000 | Takano | 215/252 |
| 6,112,923 | A | * | 9/2000 | Ma | 215/252 |
| 6,116,443 | A | | 9/2000 | Parrinello | |
| 6,276,543 | B1 | * | 8/2001 | German et al. | 215/252 |
| 6,484,896 | B2 | | 11/2002 | Ma | |
| 6,557,714 | B2 | | 5/2003 | Babcock et al. | |
| 2001/0002661 | A1 | | 6/2001 | Reidenbach | |
| 2002/0033374 | A1 | | 3/2002 | Ma | |
| 2002/0066713 | A1 | | 6/2002 | Ma | |
| 2005/0000931 | A1 | * | 1/2005 | Bosl et al. | 215/252 |

FOREIGN PATENT DOCUMENTS

| | | | | | |
|---|---|---|---|---|---|
| DE | 8815335.5 | | 12/1988 | | |
| DE | 8811108 | | 2/1989 | | |
| DE | 8815335 | | 2/1989 | | |
| EP | 0 072 924 | | 5/1989 | | |
| EP | 0410059 | | 1/1991 | | |
| EP | 0511502 | | 11/1992 | | |
| EP | 0410 059 | | 6/1994 | | |
| EP | 0 593 396 | | 1/1996 | | |
| EP | 0 511 502 | | 4/1996 | | |
| FR | 2 580 593 | | 4/1985 | | |
| FR | 2580593 | | 10/1986 | | |
| GB | 2 068 912 | | 10/1980 | | |
| GB | 2 125 382 | | 7/1983 | | |
| JP | 7291318 | | 11/1995 | | |
| JP | 07291318 | A | 11/1995 | | |
| JP | 8058817 | | 3/1996 | | |
| JP | 08058817 | | 3/1996 | | |
| JP | 8164960 | | 6/1996 | | |
| JP | 08164960 | | 6/1996 | | |
| WO | WO 91/11369 | | 8/1991 | | |
| WO | WO 01/51375 | | 7/2001 | | |
| WO | WO 03/016161 | * | 2/2003 | | 215/252 |

* cited by examiner

TAMPER EVIDENT CLOSURE WITH LOCKING BAND

This application is a DIV of U.S. application Ser. No. 10/241,416, filed Sep. 11, 2002, now abandoned, which is incorporated herein by reference.

BACKGROUND OF THE INVENTION

1. Field of the Invention

This invention relates generally to the field of packaging technology, and more specifically to tamper evident closures for containers.

2. Description of the Related Technology

Various beverages, foods, medicines and the like are delivered to the public in bottles or other containers that are provided with resealable closures. Such closures provide a benefit to the consumer in that the containers can be tightly sealed and resealed after opening, which prolongs the shelf life of the product and maintains freshness. Although resealable containers provide benefits to consumers, by their nature they permit unauthorized and sometimes undetectable tampering with the product. Accordingly, many modem consumer products are packaged using tamper evident closures, which are designed to make it apparent to a consumer that a container has been opened.

Many conventional tamper evident closures utilize what is commonly known as a tamper evident band, which is designed to be retained by the container and to rupture or become separated from the consumer removable portion of the closure during opening. Typically, the container itself will include an annular ring or other retention structure for engaging the tamper evident band. The tamper evident band and the mating retention structure of the container are usually designed so that the tamper evident band will slip over the retention structure without damage during the initial application of the closure onto the container at the packaging plant, but that subsequent removal of the tamper evident band from the container will be difficult.

One type of tamper evident band that is in commercial use includes a first portion that is frangibly connected to the consumer removable portion of the closure and a second retention portion, commonly known as a J-hook, that is molded so as to angle radially inwardly and upwardly from a lower portion of the tamper evident band in order to engage retention structure on the container. During initial application of the closure, the retention portion will slip over the retention structure because of the inward and upward angling, but once it slips over the retention structure it will lock against the lower side of the retention structure, making it difficult to remove the tamper evident band from the container. An example of such a closure is disclosed in U.S. Pat. No. 5,400,913 to Kelly. Such closures are valued for their strength and ease of application.

Unfortunately, because of the inherent elasticity of some types of plastic materials, particularly at elevated temperatures, it is possible in some instances for a closure to be removed from the container with the tamper evident band still joined to the closure. Although, it is to be emphasized, this is a relatively rare occurrence, it is to be taken seriously as it frustrates the fundamental purpose of a tamper evident closure.

Other types of closures have been developed that ensure separation of the tamper evident band from the closure during opening by arresting rotational movement of the tamper evident band with respect to the closure during opening. One example of this would be U.S. Pat. No. 5,040,692 to Julian, which discloses a tamper indicating closure in which ratchet teeth are molded into the tamper evident band. These teeth engage similar projections that are molded beneath the finish portion of a container to which the closure is applied. While closures of this type are no doubt effective, they require the molding of a relatively thick tamper evident band, which increases material costs. Accordingly, for some applications that are more sensitive to material costs it would be economically difficult to apply such technology. Moreover, it is not possible to apply structure of the type that is taught in Julian for use in a closure that utilizes a J-hook type retention structure for the tamper evident band.

A need exists for an improved J-hook type retention structure for a tamper evident band that reduces the likelihood of the closure being unscrewed from a container without separation of the tamper evident band from the rest of the closure.

SUMMARY OF THE INVENTION

Accordingly, it is an object of the invention to provide an improved J-hook type retention structure for a tamper evident band that reduces the likelihood of the closure being unscrewed from a container without separation of the tamper evident band from the rest of the closure.

In order to achieve the above and other objects of the invention, a tamper evident closure according to a first aspect of the invention includes a body portion having a base and an internally threaded downwardly depending sidewall portion; and a tamper evident band frangibly connected to the sidewall portion, the tamper evident band including a main band portion, and a J-hook retention member that includes a plurality of pleated retaining elements, and wherein each of the retaining elements has an upper portion that is constructed and arranged to engage retention structure of a container in order to prevent upward movement of the tamper evident band with respect to the container, and wherein at least one of the pleated retaining elements is further constructed and arranged to engage the container so as to resist rotation with respect to the container, whereby separation of the tamper evident band from said body portion is better assured when the closure is unscrewed from the container.

According to a second aspect of the invention, a container assembly includes a container having an externally threaded finish portion that has retention structure for retaining a tamper evident band; a closure comprising a body portion having a base and an internally threaded downwardly depending sidewall portion, the closure further comprising a tamper evident band that is frangibly connected to the sidewall portion, and wherein the tamper evident band includes: a main band portion, and a J-hook retention member that includes a plurality of pleated retaining elements, and wherein each of the retaining elements has an upper portion that is constructed and arranged to engage the retention structure in order to prevent upward movement of the tamper evident band with respect to the container, and wherein at least one of the pleated retaining elements is further constructed and arranged to engage the container so as to resist rotation with respect to the container, whereby separation of the tamper evident band from the body portion is better assured when the closure is unscrewed from the container.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
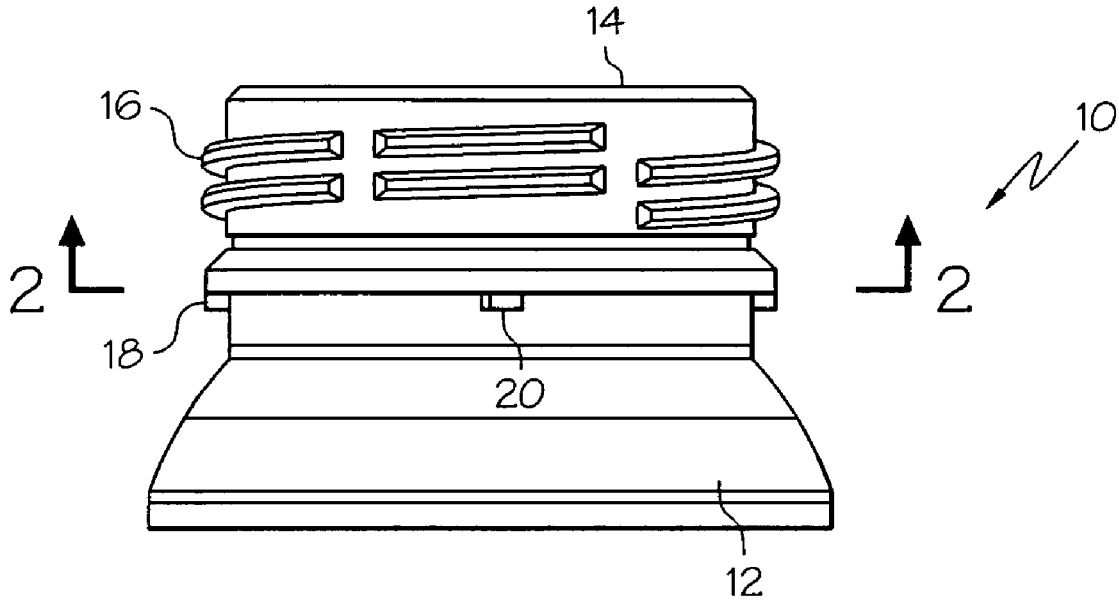
FIG. 1 is a fragmentary side elevational view of a container that is constructed according to a preferred embodiment of the invention.

Referring now to the drawings, wherein like reference numerals designate corresponding structure throughout the views, and referring in particular to FIG. 1, a container assembly 10 that is constructed according to the preferred embodiment of the invention includes a container 12 having a finish portion 14 that is molded with external threads 16. As is conventional, finish portion 14 is provided with retention structure 18 for retaining a tamper evident band by limiting upward movement of the tamper evident band after a closure has been applied to the finish portion 14 of the container assembly 10.

Figure 2:
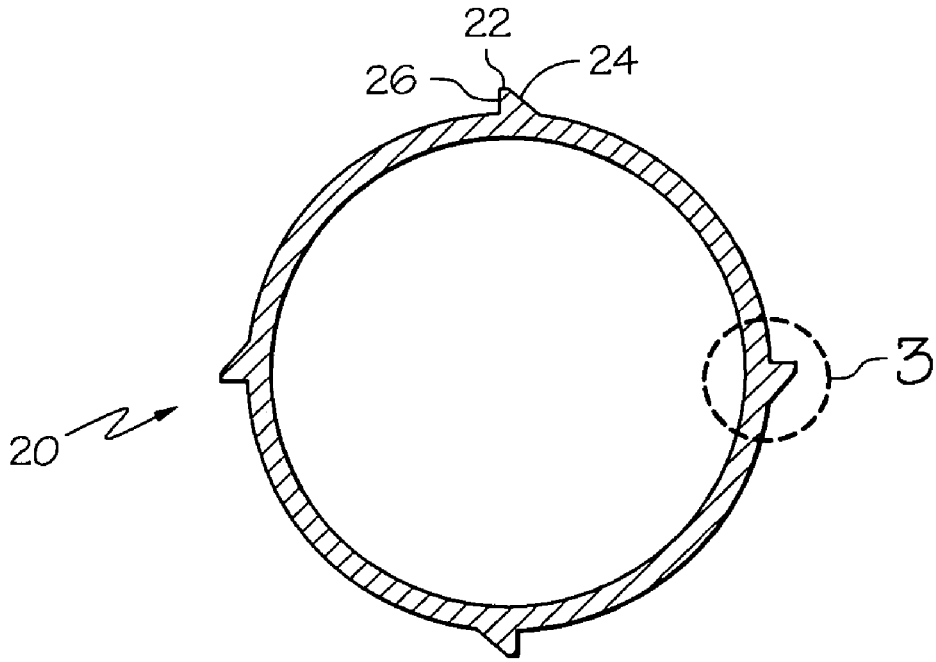
FIG. 2 is a cross-sectional view taken along lines 2-2 in FIG. 1.
Figure 3:
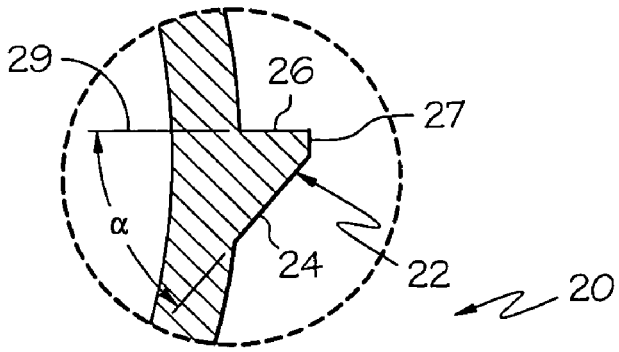
FIG. 3 is a magnified view of an area in FIGURE to that is indicated by lines 3-3 in FIG. 2.

As may further be seen in FIG. 1, container 12 further includes rotational locking structure that is constructed and arranged so as to arrest rotation of the tamper evident band with respect to the container 12, as will be described in appropriate detail below. Referring now to FIGS. 2 and 3, it will be seen that the rotational locking structure 20 is preferably embodied as four ratchet teeth 22, which are spaced about the circumference of the lower part of the finish portion 14, beneath the retention structure 18, at 90 degree intervals. As may best be seen in FIG. 3, each ratchet tooth 22 includes a ramped leading edge 24, which is angled with respect to a radius 29 of the finish portion 14 at an angle $\alpha$ so as to guide a tamper evident band such as the tamper evident band 38 described herein thereover during the initial application of a closure to the finish portion 14 of the container assembly 10. Each ratchet tooth 22 further includes a flat trailing edge 26 that is preferably flat and terminates in an edge 27 so as to arrest movement of the tamper evident band 38 in an unscrewing direction after the closure has been applied to the finish portion. As may be seen in FIG. 3, flat trailing edge 26 is preferably parallel to a radius 29 of the finish portion 14.

Figure 4:
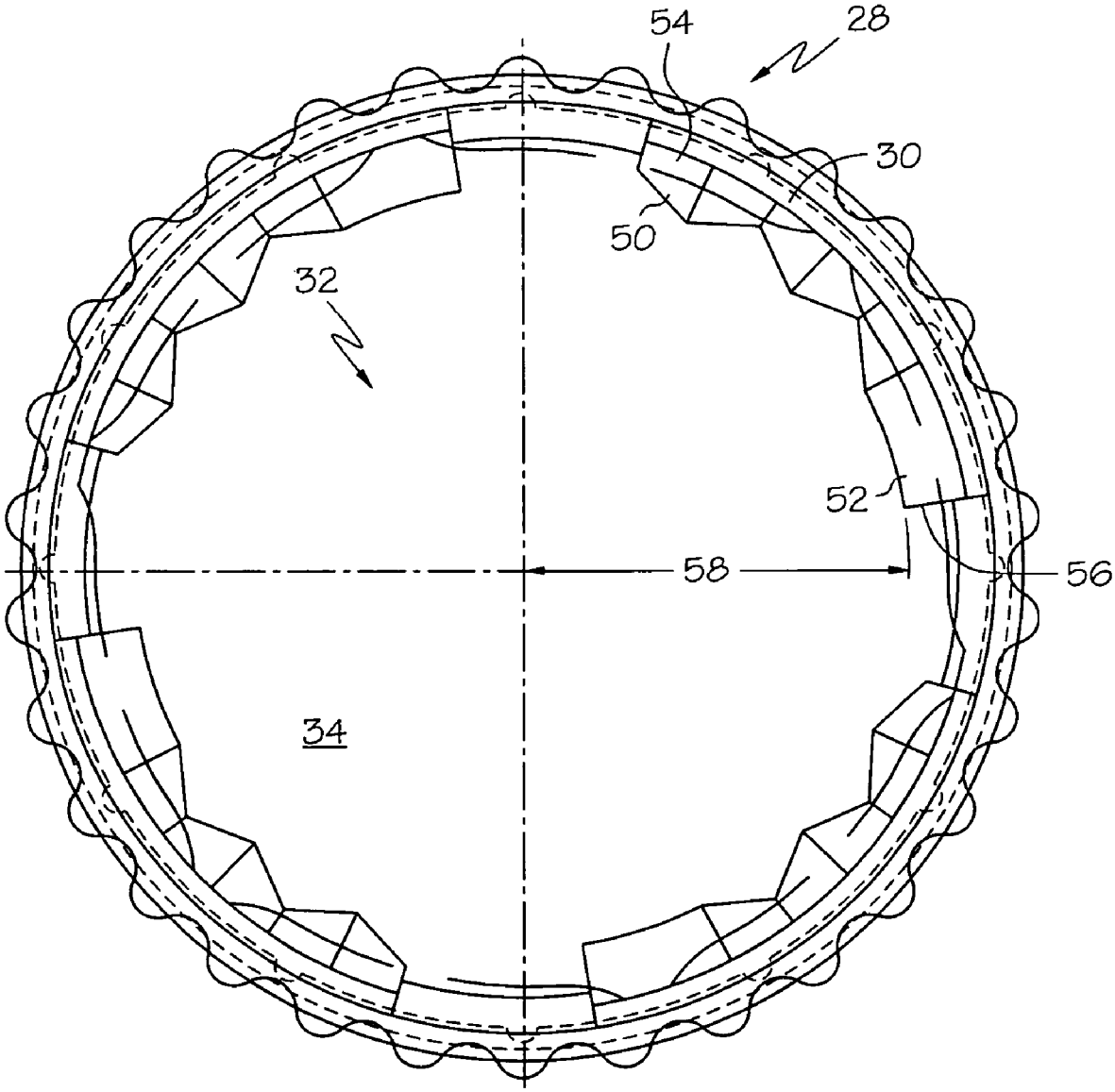
FIG. 4 is a bottom plan view of a closure according to the preferred embodiment of the invention.
Figure 5:
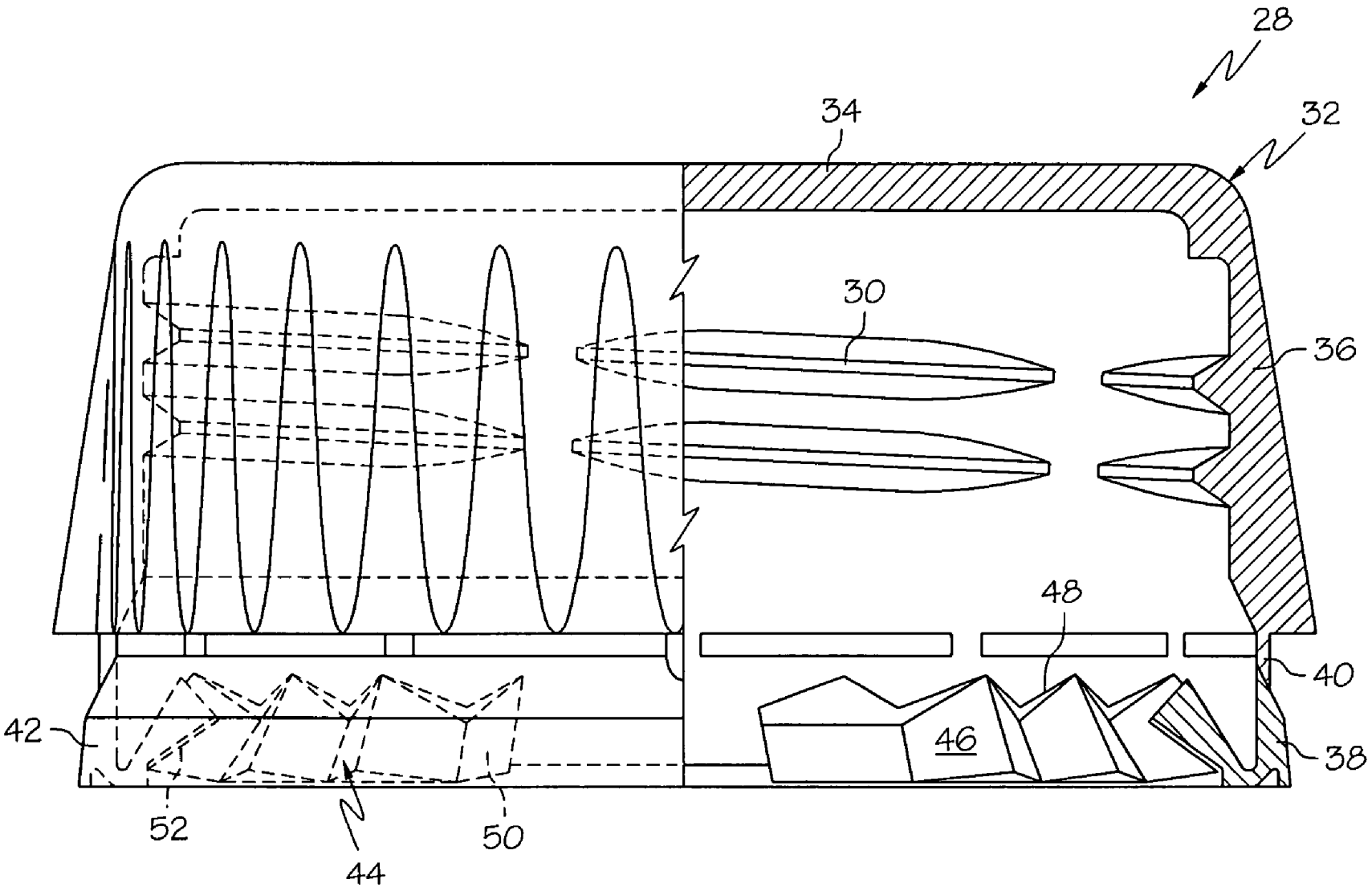
FIG. 5 is a partially diagrammatical, partially cross-sectional view depicting features of the closure that is depicted in FIG. 4.

Referring now to FIGS. 4 and 5, it will be seen that container assembly 10 further includes a closure 28 having a body portion 32 with a base 34 and a downwardly depending annular sidewall portion 36 that has internal threading 30 defined thereon. Closure 28 further includes a tamper evident band 38 that is frangibly connected to the sidewall portion 36 by a plurality of breakable bridges 40, as is well known in this area of technology. Tamper evident band 38 includes, as is best shown in FIG. 5, a main band portion 42 and a J-hook retention member 44 that includes a plurality of pleated retaining elements 46. Each of the pleated retaining elements 46 has an upper portion 48 that is constructed and arranged to engage the retention structure 18 of the container 12 in order to prevent upward movement of the tamper evident band 38 with respect to the container 12 after the closure 28 has been applied to the container 12.

According to one important aspect of the invention, at least one of the pleated retaining elements 46 is further constructed and arranged to engage the container 12 so as to resist rotation with respect to the container 12. Accordingly, separation of the tamper evident band 38 from the body portion 32 is better assured when the closure 28 is unscrewed from the container 12. More specifically, in the preferred embodiment there are four of the retaining elements 46, and each is configured so as to have a leading edge 50, best shown in FIG. 4, that is shaped so as to permit the retaining elements 46 to pass over the rotational locking structure 20 on the container 12 when the closure 28 is first applied to the container 12. As may be seen in FIG. 4, each of the leading edge is 50 include a ramped surface 54 that are ramped radially inwardly in a direction corresponding to an application motion of the closure 28 onto the container 12. Conversely, each of the retaining elements 46 also includes a trailing edge 52 that is shaped so as to firmly engage the rotational locking structure 20 when the closure 28 is being unscrewed from the container 12. As may be seen in FIG. 4, trailing edge 52 is positioned radially inwardly from the leading edge 50, and is characterized by a flat abutment surface 56 that is oriented so as to be within a plane that is substantially parallel to a radius 58 of the closure 28. Abutment surface 56 will, upon any attempt to unscrew the closure 28 from the container 12, firmly engage against the flat trailing surface 26 of the rotational locking structure 20, thereby ensuring rupture of the bridges 40 and separation of the tamper evident band 38 from the main body portion 32 of the closure 28 before any significant rotational displacement occurs between the closure 28 and the container 12.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A tamper evident closure, comprising:

a body portion comprising a base and an internally threaded downwardly depending sidewall portion; and a tamper evident band frangibly connected to said sidewall portion, said tamper evident band comprising:

a main band portion, and a J-hook retention member that includes a plurality of separate pleated retaining elements with a pleated shape on their inside and their outside, wherein at least one pleat is folded perpendicular to the lower rim of said sidewall portion, and wherein at least one of the pleated retaining elements has on its inside and on its outside at least one inwardly directed fold and at least one outwardly directed fold, and wherein each of said retaining elements has an upper portion that is constructed and arranged to engage retention structure of a container in order to prevent upward movement of said tamper evident band with respect to the container, and wherein at least one of the pleated retaining elements is further constructed and arranged to engage the container so as to resist rotation with respect to the container, whereby separation of said tamper evident band from said body portion is better assured when the closure is unscrewed from the container and wherein said at least one pleated retaining element comprises a leading edge that is shaped so as to permit said retaining element to pass over said rotational locking structure when said closure is first screwed onto the container and wherein said at least one pleated retaining element further comprises a trailing edge that is shaped so as to firmly engage said rotational locking structure when said closure is being unscrewed from the container.

2. A tamper evident closure according to claim 1, wherein said at least one pleated retaining element is constructed and arranged to engage rotational locking structure that is defined on the container.

3. A tamper evident closure according to claim 1, wherein said trailing edge is positioned radially inwardly with respect to said leading edge.

4. A tamper evident closure according to claim 1, wherein said trailing edge has an abutment surface defined thereon, said abutment surface being substantially parallel to a radius of said closure.

5. A tamper evident closure according to claim 1, wherein said leading edge is shaped so as to define a ramp that is constructed and arranged to guide over the rotational locking structure of the container.

6. A tamper evident closure according to claim 1, wherein said J-hook retention member comprises at least four of said pleated retaining elements.

7. A tamper evident closure according to claim 1, wherein said entire closure is unitarily molded from a plastic material.

8. A tamper evident closure according to claim 7, wherein said plastic material comprises high-density polyethylene.

9. A container assembly, comprising:

a container having an externally threaded finish portion, said finish portion including retention structure for retaining a tamper evident band;

a closure comprising a body portion having a base and an internally threaded downwardly depending sidewall portion, said closure further comprising a tamper evident band that is frangibly connected to said sidewall portion, and wherein said tamper evident band includes:

a main band portion, and a J-hook retention member that includes a plurality of separate pleated retaining elements with a pleated shape on their inside and their outside, wherein at least one pleat is folded perpendicular to the lower rim of said sidewall portion, and wherein at least one of the pleated retaining elements has on its inside and on its outside at least one inwardly directed fold and at least one outwardly directed fold, and wherein each of said retaining elements has an upper portion that is constructed and arranged to engage said retention structure in order to prevent upward movement of said tamper evident band with respect to said container, and wherein at least one of the pleated retaining elements is further constructed and arranged to engage said container so as to resist rotation with respect to the container, whereby separation of said tamper evident band from said body portion is better assured when the closure is unscrewed from the container and wherein said at least one pleated retaining element comprises a leading edge that is shaped so as to permit said retaining element to pass over said rotational locking structure when said closure is first screwed onto the container and wherein said at least one pleated retaining element further comprises a trailing edge that is shaped so as to firmly engage said rotational locking structure when said closure is being unscrewed from the container.

10. A container assembly according to claim 9, further comprising rotational locking structure on said container, and wherein said at least one pleated retaining element is constructed and arranged to engage said rotational locking structure so as to preclude rotation of said closure with respect to said container in at least one direction.

11. A container assembly according to claim 9, wherein said trailing edge is positioned radially inwardly with respect to said leading edge.

12. A container assembly according to claim 9, wherein said trailing edge has an abutment surface defined thereon, said abutment surface being substantially parallel to a radius of said closure.

13. A container assembly according to claim 9, wherein said leading edge is shaped so as to define a ramp that is constructed and arranged to guide over the rotational locking structure of the container.

14. A container assembly according to claim 9, wherein said J-hook retention member comprises at least four of said pleated retaining elements.

15. A container assembly according to claim 9, wherein said entire closure is unitarily molded from a plastic material.

16. A tamper evident closure according to claim 7, wherein said plastic material comprises high-density polyethylene.

17. A tamper evident closure, comprising:

a body portion comprising a base and an internally threaded downwardly depending sidewall portion; and a tamper evident band frangibly connected to said sidewall portion, said tamper evident band comprising:

a main band portion, and a J-hook retention member that includes a plurality of separate pleated retaining elements with a pleated shape on their inside and their outside, wherein at least one pleat is folded perpendicular to the lower rim of said sidewall portion, and wherein at least one of the pleated retaining elements has on its inside and on its outside at least one inwardly directed fold and at least one outwardly directed fold and wherein each of said retaining elements has an upper portion that is constructed and arranged to engage retention structure of a container in order to prevent upward movement of said tamper evident band with respect to the container, and wherein a part of the pleated retaining elements is further constructed and arranged to engage the container so as to resist rotation with respect to the container, whereby separation of said tamper evident band from said body portion is better assured when the closure is unscrewed from the container and wherein said at least one pleated retaining element comprises a leading edge that is shaped so as to permit said retaining element to pass over said rotational locking structure when said closure is first screwed onto the container and wherein said at least one pleated retaining element further rises a trailing edge that is shaped so as to firmly engage said rotational locking structure when said closure is being unscrewed from the container.

* * * * *